US009423183B2

(12) United States Patent
Yoko et al.

(10) Patent No.: US 9,423,183 B2
(45) Date of Patent: Aug. 23, 2016

(54) HEAT TREATMENT METHOD

(71) Applicant: MITSUBISHI HEAVY INDUSTRIES, LTD., Tokyo (JP)

(72) Inventors: Kazutoshi Yoko, Tokyo (JP); Hiroko Kitamoto, Tokyo (JP); Shimpei Okayasu, Tokyo (JP); Hiroki Takagi, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 189 days.

(21) Appl. No.: 14/378,360

(22) PCT Filed: Feb. 15, 2013

(86) PCT No.: PCT/JP2013/053673

§ 371 (c)(1),
(2) Date: Aug. 13, 2014

(87) PCT Pub. No.: WO2013/122192

PCT Pub. Date: Aug. 22, 2013

(65) Prior Publication Data

US 2015/0017593 A1 Jan. 15, 2015

(30) Foreign Application Priority Data

Feb. 17, 2012 (JP) ..... 2012-033135

(51) Int. Cl.
*C21D 9/00* (2006.01)
*F27D 7/02* (2006.01)
(Continued)

(52) U.S. Cl.
CPC .. *F27D 7/02* (2013.01); *C21D 1/34* (2013.01); *C21D 1/767* (2013.01); *C21D 1/773* (2013.01);
(Continued)

(58) Field of Classification Search
CPC ..... C21D 9/068; C21D 9/00
USPC ..... 432/31, 65, 175, 225, 226; 416/95
See application file for complete search history.

(56) References Cited

U.S. PATENT DOCUMENTS

| | | | | | |
|---|---|---|---|---|---|
| 1,975,422 | A * | 10/1934 | Hellenbroich | B23P 19/00 | 219/161 |
| 4,570,053 | A * | 2/1986 | Ades | B23P 11/025 | 219/385 |
| 4,596,526 | A | 6/1986 | Soliman | | |
| 5,934,871 | A * | 8/1999 | Murphy | C21D 9/0006 | 415/1 |
| 7,874,835 | B2 * | 1/2011 | Schwank | F23D 14/12 | 126/104 A |

FOREIGN PATENT DOCUMENTS

| | | |
|---|---|---|
| DE | 82746 | 6/1971 |
| JP | 58-19443 | 2/1983 |

(Continued)

OTHER PUBLICATIONS

International Search Report issued Apr. 2, 2013 in corresponding International Application No. PCT/JP2013/053673.

(Continued)

*Primary Examiner* — Gregory A Wilson
(74) *Attorney, Agent, or Firm* — Wenderoth, Lind & Ponack, L.L.P.

(57) ABSTRACT

A heat treatment method of an impeller includes a heat treatment preparation process of arranging the impeller within a vacuum furnace, an impeller covering process of covering an outer peripheral surface of the impeller in a circumferential direction by a heat uniformizing jig made of a radiation conversion material which radiates transferred heat as radiant heat, and a heat treatment process including a heating process and a cooling process in which heat treatment is performed by heating or cooling the impeller covered with the heat uniformizing jig from the periphery using a heater.

9 Claims, 6 Drawing Sheets

(51) Int. Cl.

| | |
|---|---|
| ***C21D 1/34*** | (2006.01) |
| ***F04D 29/02*** | (2006.01) |
| ***F04D 29/28*** | (2006.01) |
| ***C21D 1/767*** | (2006.01) |
| ***C21D 1/773*** | (2006.01) |
| ***F27B 5/04*** | (2006.01) |
| ***C21D 9/67*** | (2006.01) |
| ***C21D 9/673*** | (2006.01) |
| ***C21D 9/677*** | (2006.01) |
| ***F27B 17/00*** | (2006.01) |
| *C21D 9/32* | (2006.01) |
| *C21D 9/34* | (2006.01) |
| *F27B 5/16* | (2006.01) |

(52) U.S. Cl.

CPC ..... *C21D 9/00* (2013.01); *C21D 9/0068* (2013.01); *C21D 9/67* (2013.01); *C21D 9/673* (2013.01); *C21D 9/677* (2013.01); *F04D 29/023* (2013.01); *F04D 29/284* (2013.01); *F27B 5/04* (2013.01); *F27B 17/0075* (2013.01); *F27B 17/0083* (2013.01); *C21D 9/32* (2013.01); *C21D 9/34* (2013.01); *F05D 2230/40* (2013.01); *F27B 2005/168* (2013.01)

(56) References Cited

FOREIGN PATENT DOCUMENTS

| | | |
|---|---|---|
| JP | 61-110717 | 5/1986 |
| JP | 3-193816 | 8/1991 |
| JP | 4-325634 | 11/1992 |
| JP | 6-18015 | 1/1994 |
| JP | 6-145781 | 5/1994 |
| JP | 7-90388 | 4/1995 |
| JP | 10-287437 | 10/1998 |
| JP | 2000-18192 | 1/2000 |
| JP | 2009-156122 | 7/2009 |
| JP | 2010-230012 | 10/2010 |

OTHER PUBLICATIONS

Translation of Written Opinion of the International Searching Authority issued Apr. 2, 2013 in corresponding International Application No. PCT/JP2013/053673.

Extended European Search Report issued Sep. 21, 2015 in European Application No. 13748875.5.

* cited by examiner

HEAT TREATMENT METHOD

FIELD OF THE INVENTION

The present invention relates to a heat treatment method of a disc-shaped treatment target material.

Priority is claimed on Japanese Patent Application No. 2012-033135, filed Feb. 17, 2012, the content of which is incorporated herein by reference.

BACKGROUND ART

For example, an impeller (see Patent Literature 1) used for a centrifugal compressor or the like is a member requiring high hardness and high toughness since the impeller is exposed to a compression medium while constantly rotating and centrifugal force and high pressure act thereon. For this reason, the impeller is subjected to heat treatment in which it is heated to a predetermined temperature to be tempered within a heating furnace (see Patent Literatures 2 and 3) and is then quenched by blowing a fluid such as nitrogen gas, and thereby has a degree of hardness and toughness suitable for required specifications.

In this way, the impeller is subjected to the heat treatment. However, when heaters arranged on a wall portion within the furnace are not installed all around the wall portion during heating of the impeller, the degree of heating differs between parts in which the impeller is close to the heaters and parts in which the impeller is distanced from the heaters, thereby generating a temperature distribution in the impeller. In addition, even when the impeller is quenched by the nitrogen gas, it is difficult to uniformly blow the nitrogen gas and a flow distribution of nitrogen is wholly generated in the impeller. Accordingly, a temperature distribution is also generated in the impeller.

In particular, this situation is easily generated in a large impeller and the impeller has a variation in hardness and toughness due to the temperature distribution during the heat treatment. For this reason, when centrifugal force acts on the impeller by rotation thereof, there is a possibility that the hardness and toughness may differ at every part of the impeller which may cause oval deformation.

Therefore, a conventional heat treatment is performed in a state in which extra thickness is provided in an impeller and then an uneven portion of the extra thickness is removed by machining and the like, in consideration of the above deformation, so as to correspond to a variation in hardness and toughness generated during the heat treatment.

Here, for example, reducing the temperature distribution generated during heating of the impeller by installing a heat shield plate for shielding heat such that a part of the impeller facing a heater is not directly affected by the heater during heating of the impeller or by installing a stirring fan for uniformizing an atmosphere in a furnace and a temperature thereof may be considered.

RELATED ART DOCUMENT

Patent Literature

[Patent Literature 1]

Japanese Unexamined Patent Application, First Publication No. 2009-156122

[Patent Literature 2]

Japanese Unexamined Patent Application, First Publication No. H10-287437

[Patent Literature 3]

Japanese Unexamined Patent Application, First Publication No. H06-145781

SUMMARY OF INVENTION

Technical Problem

However, when the above heat shield plate is provided, even though a heat uniformizing effect is partially obtained, heating takes a long time because heat is blocked by the heat shield plate. In addition, it is difficult to effectively perform heat uniformizing during heating even when convection of gas in the furnace is accelerated by installing the stirring fan in the furnace. Moreover, even though the heat uniformizing is realized during heating, uniform cooling may not be achieved during cooling, resulting in a variation in hardness, yield strength, tensile strength, and toughness in the impeller. Accordingly, when a disc-shaped treatment target material such as an impeller is heat treated, there is a need to perform heat treatment in a state in which extra thickness is provided in the material so as to include an uneven portion generated during the heat treatment and then remove the extra thickness. For this reason, there is a need to increase the size of a heat treatment apparatus according to the extra thickness or to decrease the treatment target material after finishing according to the extra thickness. In addition, since a heat capacity is increased by providing extra thickness to resolve unevenness in the heat treatment, heat treatment costs may be increased.

The present invention has been made in view of the above problems, and an object of the present invention is to provide a heat treatment method of a member to be treated, capable of reducing extra thickness while preventing a heat treatment time from lengthening.

Solution to Problem

According to a first aspect of the present invention, a heat treatment method of a disc-shaped treatment target material includes a treatment target material covering process of covering an outer peripheral surface of the treatment target material in a circumferential direction with a covering body made of a radiation conversion material which radiates transferred heat as radiant heat, and a heat treatment process of performing heat treatment by heating or cooling the treatment target material covered with the covering body from the periphery.

In accordance with the heat treatment method, the heat treatment process is performed in a state in which the treatment target material is covered in the circumferential direction by the covering body made of the radiation conversion material by the treatment target material covering process. Therefore, after transferred heat enters the covering body and heats the covering body, the heat may be uniformly radiated from the covering body to the treatment target material in the circumferential direction. That is, since the transferred heat is emitted through the covering body instead of directly entering the treatment target material, the covering body may simply block the transferred heat, and the heat that is unevenly transferred to the covering body in the circumferential direction by convection may uniformly heat the entire covering body by heat conduction within the covering body. In addition, since the covering body is made of the radiation conversion material, the covering body, which is uniformly heated by the heat conduction, may uniformly radiate heat to the treatment target material by radiant heat transfer in the circumferential direction. Therefore, it may be possible to prevent the required time for the heat treatment from lengthening and to achieve heat uniformizing in the heat treatment process.

In addition, in the treatment target material covering process, a member made of the radiation conversion material having permeability may be used as the covering body, and in the heat treatment process, a fluid in a heat treatment atmosphere may flow from the outside of the covering body to the treatment target material due to permeability of the covering body.

Since the covering body is made of the radiation conversion material having permeability, it may be possible to suppress a fluid from stagnating between the covering body and the treatment target material and to reduce the time for the heat treatment.

Furthermore, in the treatment target material covering process, the treatment target material may also be covered from an axial direction by the covering body.

Since the covering body covers the treatment target material from an axial direction in addition to the circumferential direction, the radiant heat transfer may be performed from an overall direction to the treatment target material and the heat uniformizing may be further achieved during the heat treatment.

In addition, the treatment target material may be an impeller having an axial hole into which a rotary shaft is capable of being inserted, the heat treatment method may further include a first insertion process of inserting an axial hole insertion body made of the radiation conversion material into the axial hole, and the heat treatment process may be performed in a state in which the axial hole insertion body is inserted into the axial hole.

Since the radiant heat transfer may be increased within the axial hole, in which stagnation of a fluid in a heat treatment atmosphere may be easily generated, by the first insertion process of inserting the axial hole insertion body, the heat uniformizing may be further achieved during the heat treatment.

Furthermore, the treatment target material may be an impeller having a passage therein, the heat treatment method may further include a second insertion process of inserting a passage insertion body made of the radiation conversion material into the passage, and the heat treatment process may be performed in a state in which the passage insertion body is inserted into the passage.

Since the radiant heat transfer may be increased within the passage, in which stagnation of a fluid in a heat treatment atmosphere may be easily generated, the heat uniformizing may be further achieved during the heat treatment due to the second insertion process of inserting the passage insertion body.

Advantageous Effects of Invention

According to a heat treatment method of the present invention, in a heat treatment method, extra thickness may be reduced while achieving heat uniformizing in a heat treatment process and preventing a heat treatment time from becoming longer, by performing a treatment target material covering process using a covering body made of a radiation conversion material.

DESCRIPTION OF EMBODIMENTS

Hereinafter, a heat treatment method of an impeller 1 as a disc-shaped treatment target material according to a first embodiment of the present invention will be described.

Figure 1:
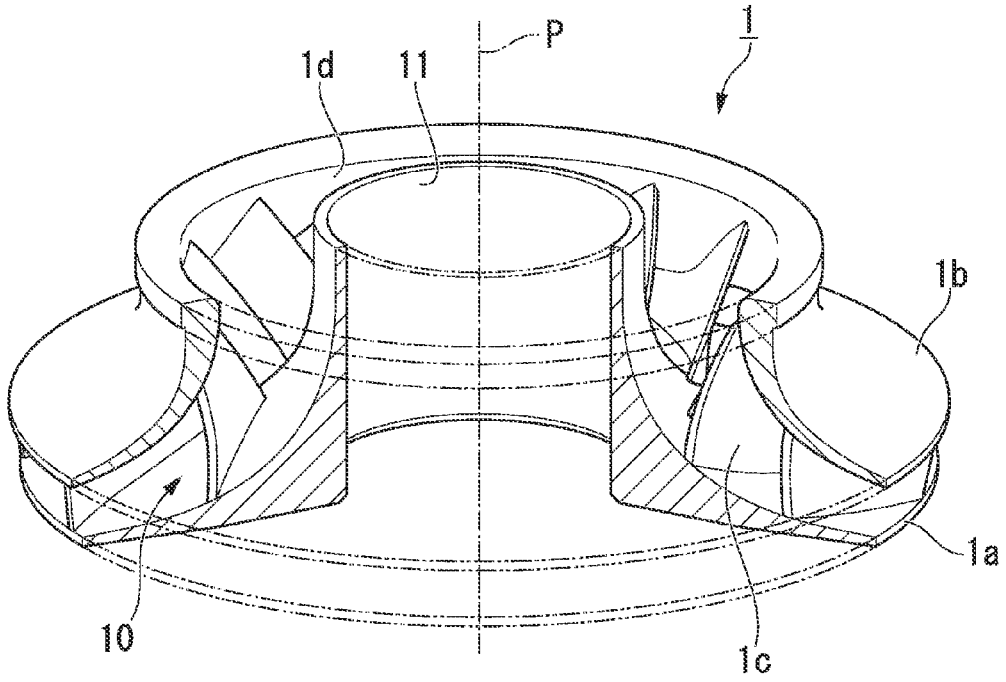
FIG. 1 is a perspective view illustrating a cut state of an impeller according to a first embodiment of the present invention.

As shown in FIG. 1, the impeller 1, which is heat treated by the present embodiment, is used for a rotary machine such as a compressor for increasing pressure of a fluid.

In addition, the impeller 1 includes a disc 1*a*, a cover 1*b*, and blades 1*c*, which are formed integrally with each other on the basis of an axis line P.

The disc 1*a* is a member having a substantial disc shape. The disc 1*a* has a small diameter end face toward one side in the direction of the axis line P and a large diameter end face toward the other side in the direction of the axis line P. These two end faces are connected to each other by a curved surface having a diameter which is gradually increased from one end side to the other end side.

The blades 1*c* are provided in a plural number at regular intervals in the circumferential direction so as to rise from the curved surface in the disc 1*a*.

In addition, each of the blades 1*c* extends from the inside to the outside in the radial direction of the disc 1*a* to be curved toward one direction of the circumferential direction The cover 1*b* is a member which is formed integrally with the plurality of blades 1*c* so as to cover the blades 1*c* from one side in the direction of the axis line P. In addition, the cover 1*b* has a substantial disc shape when viewed from the direction of the axis line P on the basis of the axis line P. In more detail, the cover 1*b* has an umbrella shape having a diameter which is gradually decreased toward one side in the direction of the axis line P. The inside in the radial direction of the cover 1*b* has a cylindrical shape rising toward one side in the direction of the axis line P.

In addition, a region interposed between two blades 1*c* adjacent to the disc 1*a* and the cover 1*b* forms passages 10 in which a fluid flows. Moreover, the inside in the radial direction of each of the passages 10 rises toward one side of the axis line P so that an introduction port 1*d* into which the fluid is introduced in the direction of the axis line P is opened in a region interposed between the cover 1*b* and the disc 1*a*.

Furthermore, the impeller 1 is provided, at a center thereof, with an axial hole 11 penetrated in the direction of the axis line P such that a rotor (a rotary shaft), which is not shown, is fixedly inserted from the direction of the axis line P to the axial hole 11 so as to integrally rotate the impeller 1 and the rotor.

Next, a procedure for the heat treatment method of the impeller 1 will be described.

Figure 2:
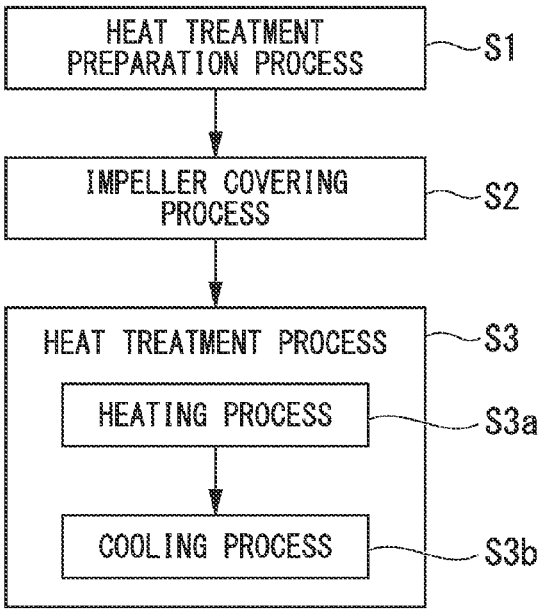
FIG. 2 is a process flowchart illustrating a heat treatment method of the impeller according to the first embodiment of the present invention.
Figure 3:
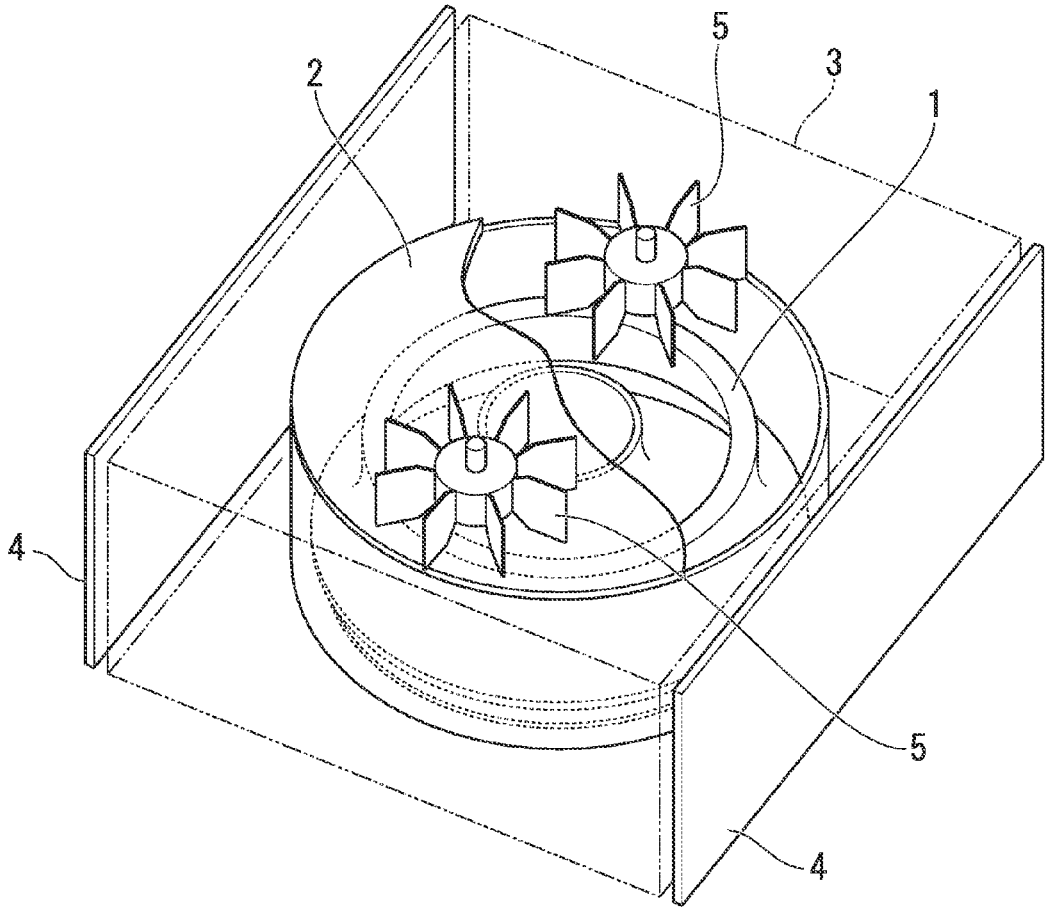
FIG. 3 is a perspective view illustrating an impeller covering process in the heat treatment method of the impeller according to the first embodiment of the present invention.
Figure 4:
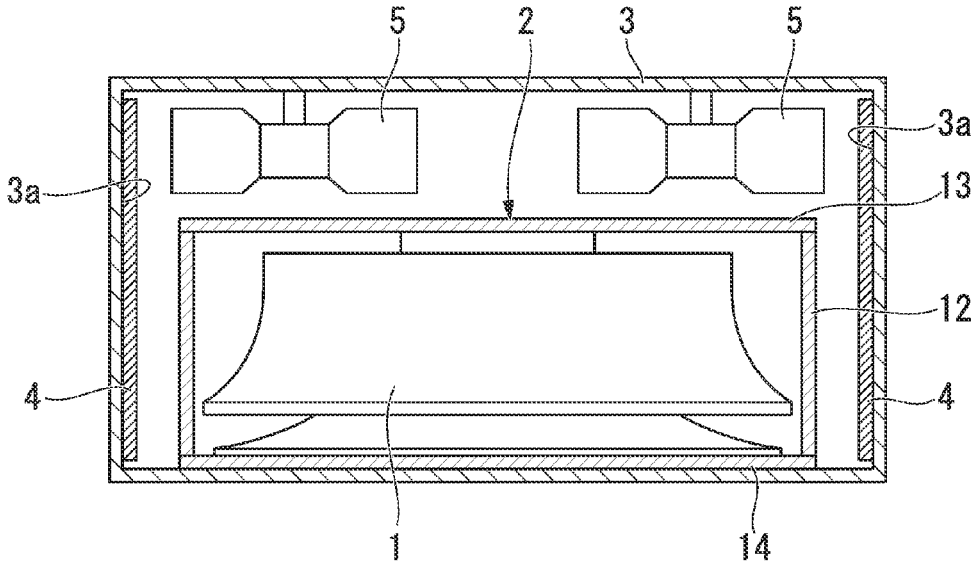
FIG. 4 is a side view illustrating the impeller covering process in the heat treatment method of the impeller according to the first embodiment of the present invention.

As shown in FIGS. 2 to 4, the heat treatment method of the impeller 1 includes a heat treatment preparation process S1 of arranging the impeller 1 before the heat treatment within a vacuum furnace 3 as a heating furnace, an impeller covering process (a treatment target material covering process) S2 of covering the impeller 1 with a heat uniformizing jig (a covering body) 2 in the vacuum furnace 3, and a heat treatment process S3 of heating or cooling the impeller 1 from the periphery in a state in which the impeller 1 is covered with the heat uniformizing jig 2.

First, the heat treatment preparation process S1 is performed. That is, the impeller before the heat treatment, which is manufactured by forging and the like, is arranged and prepared in the vacuum furnace 3.

Here, the vacuum furnace 3 is a type of heat treatment furnace which may suppress an oxidation reaction during the heat treatment by maintaining an inner portion of the furnace at a pressure lower than atmospheric pressure. In addition, two stirring fans 5 for stirring an atmosphere fluid in the vacuum furnace 3 are provided at an interval on an upper surface of the inner portion of the vacuum furnace 3, and heaters 4 are wholly provided only on two facing surfaces (two surfaces located in the left and right directions in FIG. 4) out of the four surfaces of a furnace sidewall 3*a* within the vacuum furnace 3.

Next, the impeller covering process S2 is performed. That is, the impeller 1 arranged within the vacuum furnace 3 is covered by the heat uniformizing jig 2 from the circumferential direction and the direction of the axis line P within the vacuum furnace 3. The heat uniformizing jig 2 may cover the impeller 1 while spaced apart from the impeller 1 or in contact with the impeller 1. However, a method of transferring heat from the heat uniformizing jig 2 to the impeller 1 differs between a spaced part and a contact part. Accordingly, it is preferable to cover the impeller 1 in the spaced state when possible and the contact part is preferably disposed to be rotationally symmetric.

Here, the heat uniformizing jig 2 is a member which is made of a radiation conversion material having high emissivity. The heat uniformizing jig 2 has a peripheral wall portion 12 having a cylindrical shape centered on the axis line P, and an upper bottom surface 13 and a lower bottom surface 14 which close upper and lower openings on the peripheral wall portion 12 from the direction of the axis line P, so as to cover the entire impeller 1. The emissivity is preferably 80% or more.

In addition, a silica sintered body, a sintered metal, or a high radiation cloth (Sourcil blanc (registered trademark), etc.) is used, for example, as the radiation conversion material. When the high radiation cloth is adopted, it is preferable in terms of costs.

Moreover, the radiation conversion material also has permeability and it is preferable that porosity as an index of the permeability be about 50 to 90%.

Next, the heat treatment process S3 is performed. The heat treatment process S3 includes a heating process S3*a* and a cooling process S3*b* performed after the heating process S3*a*.

In the heating process S3*a*, the inner portion of the vacuum furnace 3 is heated to a predetermined temperature by the heaters 4 and quenching is performed on the impeller 1.

The predetermined temperature in the heating process S3*a* is determined according to the material of the impeller 1 and the purpose of the heat treatment. For example, the temperature in the quenching treatment of the impeller made of SNCM is 820 to 900° C.

In addition, after the impeller 1 is increased to the predetermined temperature in the heating process S3*a* and is maintained for a predetermined time, the cooling process S3*b* cools the impeller 1 to a predetermined temperature in consideration of a change of a required material structure, thereby achieving a required hardness and yield strength. In this case, there is also a case in which nitrogen gas (a fluid) G is blown into the vacuum furnace 3 from the bottom or top thereof, and quenching is performed so that the impeller 1 is cooled to a predetermined temperature in consideration of a change of a required material structure, thereby achieving a required hardness and yield strength.

The predetermined temperature in the cooling process S3*b* is determined according to the material of the impeller 1 and the purpose of the heat treatment. For example, the temperature in the tempering treatment of the impeller made of SNCM is 580 to 630° C.

In the heat treatment method of the impeller 1, the heating process S3*a* of the heat treatment process S3 is performed in a state in which the entire impeller 1 is covered from the circumferential direction and the direction of the axis line P by the heat uniformizing jig 2 using the radiation conversion material in the impeller covering process S2. That is, when the inner portion of the vacuum furnace 3 is heated by the heaters 4, heat from the heaters 4 primarily heats the heat uniformizing jig 2 instead of being directly transferred to the impeller 1.

Here, since the heat uniformizing jig 2 is made of the radiation conversion material, the heat uniformizing jig 2 may uniformly transfer heat transferred from the heaters 4 to the impeller 1 from the circumferential direction and the direction of the axis line P as radiant heat having high thermal emissivity. In more detail, the heat uniformizing jig 2 simply blocks heat from the heaters 4, and primarily, heat that is unevenly transferred to the heat uniformizing jig 2 in the circumferential direction by radiation and convection uniformly heats the entire heat uniformizing jig 2 by heat conduction within the heat uniformizing jig 2. Since the heat uniformizing jig 2 is made of the radiation conversion material, the heat uniformizing jig 2, which is uniformly heated by the heat conduction, may uniformly radiate heat to the impeller 1 by radiant heat transfer. Therefore, it may be possible to prevent a required time for the heat treatment from lengthening, to prevent only parts of the impeller 1 close to the heaters 4 from being easily heated, and to prevent a degree of heating from differing. As a result, the quenching may be uniformly performed.

In the present embodiment, since the impeller 1 is arranged on the lower bottom surface 14 of the heat uniformizing jig 2, heating of the impeller 1 from the downward side thereof is mainly performed by heat conduction from the lower bottom surface 14. Even in this case, since the impeller 1 comes into contact with the lower bottom surface 14 at a part which is rotationally symmetric to the axis line P of the impeller, the degree of heating is not different.

Figure 5:
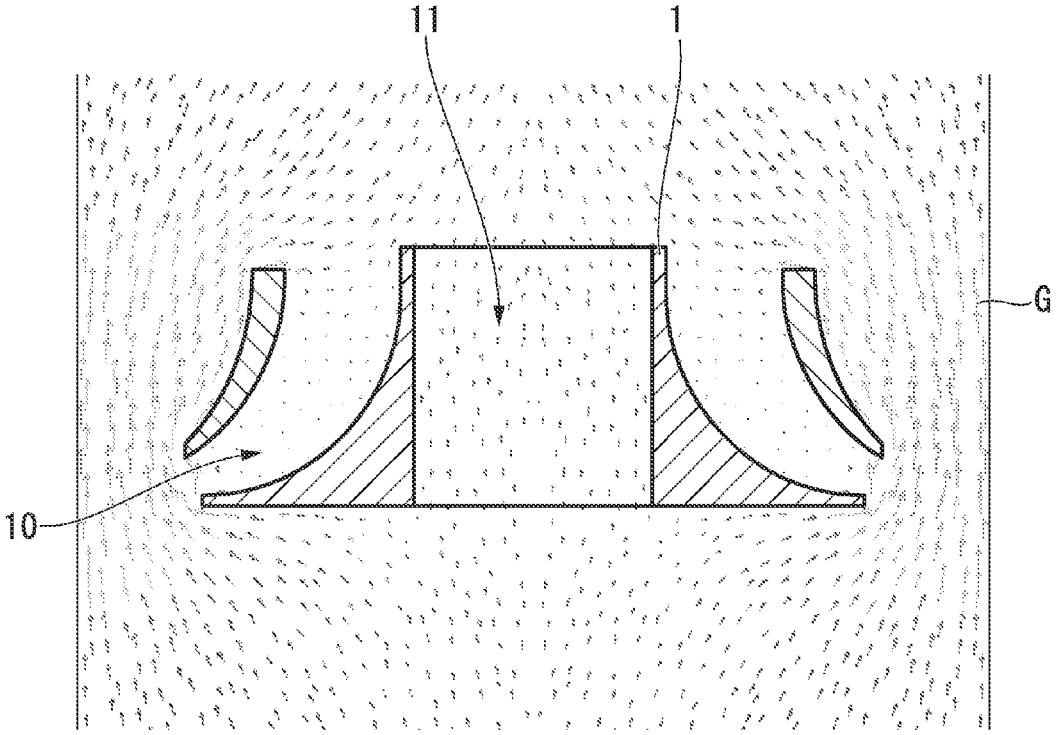
FIG. 5 is a side view analyzing a flow state of a nitrogen gas in a cooling process if the impeller covering process is not performed in the heat treatment method of the impeller according to the first embodiment of the present invention.

In addition, as shown in an analyzed result of FIG. 5, it may be identified that, in the conventional method, when the nitrogen gas G is blown from the bottom in the cooling process S3*b*, a flow distribution of the nitrogen gas G is not uniform. That is, after the nitrogen gas G comes into contact with the disc 1*a* at the lower portion of the impeller 1, the nitrogen gas G flows to be dispersed outward in the radial direction of the impeller 1.

Similarly to the heating process S3*a*, in the cooling process S3*b* of the present embodiment, the impeller 1 may be uniformly cooled using radiant heat transfer by covering the impeller 1 with the heat uniformizing jig 2. Moreover, the heat uniformizing jig 2 has permeability. Therefore, when the nitrogen gas G is blown in the cooling process S3*b*, it may be possible to suppress the nitrogen gas G from stagnating between the heat uniformizing jig 2 and the impeller 1. Accordingly, it may be possible to reduce the time for the heat treatment process S3 by effectively improving convection heat transfer. In addition, although not shown, an analysis in a state in which the heat uniformizing jig 2 is provided is also performed by setting the permeability of the heat uniformizing jig 2 to have porosity of 80%. Consequently, a preferable result is obtained.

Since the heat treatment method of the impeller 1 of the present embodiment uses the radiant heat transfer by the heat uniformizing jig 2, it may be possible to achieve uniform heating and uniform cooling in the heat treatment process S3. Accordingly, there is no need to perform the heat treatment in a state in which the extra thickness is provided in the impeller 1 as in the related art. Thus, it may also be possible to reduce working man-hours of the extra thickness and reduce material costs by a reduction of the extra thickness. In addition, since the heat uniformizing jig 2 formed of the radiation conversion material having high emissivity is disposed to surround the impeller 1, heating efficiency may be improved. Therefore, since a required time for the heat treatment process may be prevented from becoming longer and a time for the cooling process S3*b* may be reduced, an overall required time for the heat treatment process S3 may be reduced.

Figure 6:
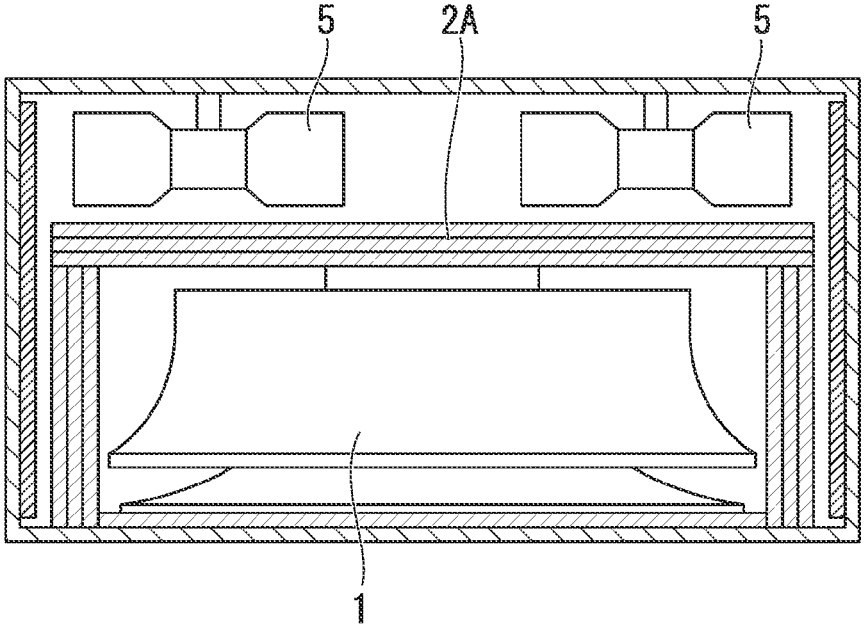
FIG. 6 is a side view illustrating a different heat uniformizing jig in the impeller covering process in the heat treatment method of the impeller according to the first embodiment of the present invention.

As shown in FIG. 6, a plurality of heat uniformizing jigs 2A may also be stacked and disposed in the circumferential direction and the direction of the axis line P. Uniform heating and uniform cooling may be more securely achieved by properly changing a thickness of the heat uniformizing jig 2 to adjust a radiant heat quantity and permeability corresponding to the dimensions and shape of the impeller 1.

Figure 7:
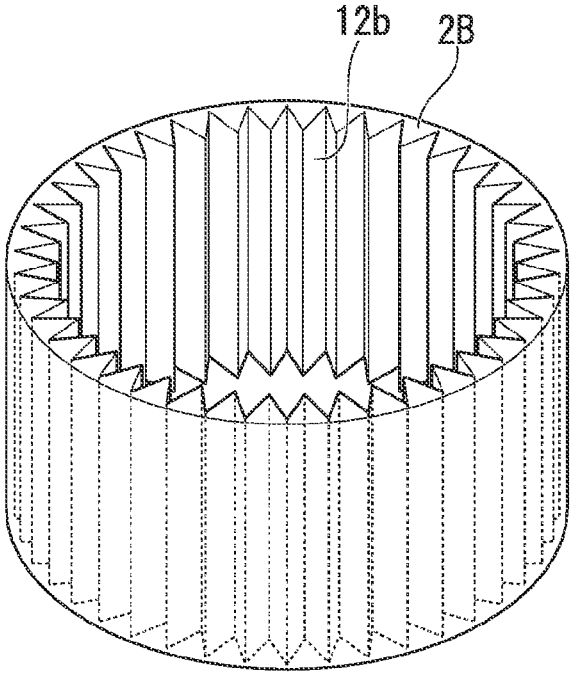
FIG. 7 is a perspective view illustrating a different heat uniformizing jig in the impeller covering process in the heat treatment method of the impeller according to the first embodiment of the present invention.

As shown in FIG. 7, a heat uniformizing jig 2B may also have a plurality of convex portions 12*b* protruding toward an inner peripheral side from an inner peripheral surface of the peripheral wall portion 12. In this case, it may be possible to increase a heat transfer area inside the heat uniformizing jig 2 and to effectively improve radiant heat transfer.

Next, a heat treatment method of an impeller 1 according to a second embodiment of the present invention will be described.

Like reference numerals refer to the same elements as those of the first embodiment and no detailed description thereof will be given.

Figure 8:
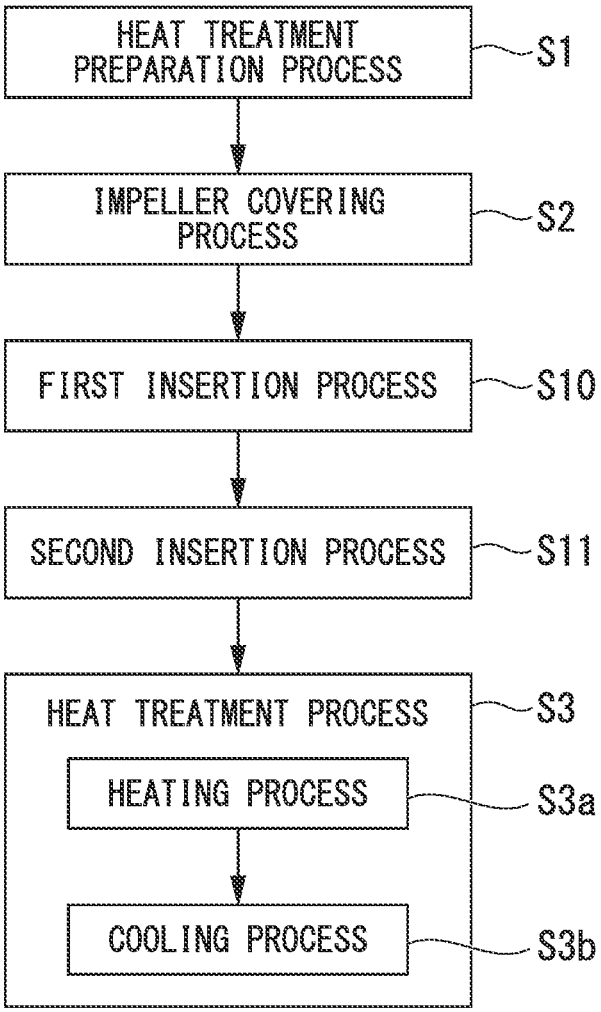
FIG. 8 is a process flowchart illustrating a heat treatment method of an impeller according to a second embodiment of the present invention.

As shown in FIG. 8, the heat treatment method of the present embodiment differs from that of the first embodiment in that the heat treatment method of the present embodiment further includes a first insertion process S10 and a second insertion process S11 after the impeller covering process S2.

Figure 9:
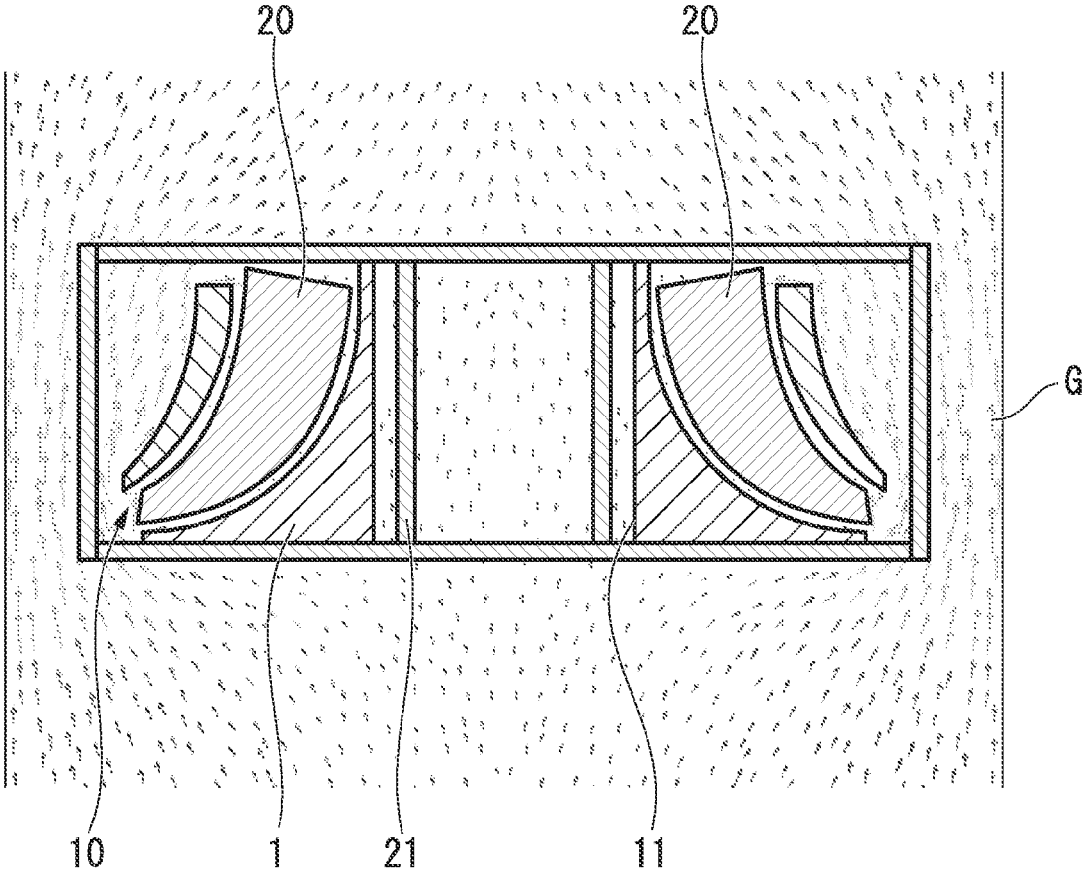
FIG. 9 is a side view illustrating a first insertion process and a second insertion process in the heat treatment method of the impeller according to the second embodiment of the present invention.

As shown in FIG. 9, the first insertion process S10 is performed before the heat treatment process S3. That is, an axial hole insertion jig (an axial hole insertion body) 21, which is made of the cylinder-shaped radiation conversion material corresponding to the shape of the axial hole 11, is inserted into the axial hole 11 of the impeller 1. The axial hole insertion jig 21 may also be maintained within the passage 10 so as to be hung from the upward side or may also be maintained in contact with the axial hole 11, in the inner portion of the vacuum furnace 3.

Furthermore, the second insertion process S11 is performed after the first insertion process S10. That is, a passage insertion jig (a passage insertion body) 20, which is made of the radiation conversion material corresponding to the shape of the passage 10, is inserted into each passage 10 of the impeller 1. Similarly to the axial hole insertion jig 21, the passage insertion jig 20 may also be maintained within the passage 10 so as to be hung from the upward side or may also be maintained in the passage 10 by coming in contact therewith, in the inner portion of the vacuum furnace 3.

In this case, a method of inserting the passage insertion jig 20 and the axial hole insertion jig 21 between the axial hole 11 and the axial hole insertion jig 21 and between the passage 10 and the passage insertion jig 20 in a state in which clearances are formed therebetween may improve fluidity of the nitrogen gas in the cooling process S3*b* and more effectively improve convection heat transfer.

In accordance with the heat treatment method of the impeller 1, the heat treatment process S3 is performed in a state in which the passage insertion jig 20 and the axial hole insertion jig 21 are respectively inserted into the passage 10 and the axial hole 11 by the first and second insertion processes S10 and S11. For this reason, the radiant heat may be securely transferred to the passage 10 and the axial hole 11 since heat does not easily spread out, and uniform heating and uniform cooling of the impeller 1 may be further achieved in the heat treatment process S3. Consequently, quenching and tempering may be uniformly achieved.

In addition, since each of the axial hole insertion jig 21 and the passage insertion jig 20 is made of the radiation conversion material and has permeability, the nitrogen gas G may spread to the passage 10 and the axial hole 11. Therefore, it may be possible to reduce a required time for the cooling process S3*b* by an increase of convection heat transfer.

Since the heat treatment method of the impeller 1 according to the present embodiment may further achieve uniform heating and uniform cooling in the heat treatment process S3 by means of the axial hole insertion jig 21 and the passage insertion jig 20 in addition to the heat uniformizing jig 2, it may be possible to reduce the extra thickness of the impeller. In addition, it may be possible to reduce the time for the heat treatment in the cooling process S3*b* and to further reduce an overall required time for the heat treatment process S3.

Both of the first and second insertion processes S10 and S11 need not necessarily be performed, and need not be performed sequentially.

In addition, as in the heat uniformizing jig 213 shown in FIG. 7, the axial hole insertion jig 21 and the passage insertion jig 20 may also each form, for example, convex portions on the outer peripheral surfaces thereof so as to increase a heat transfer area. In this case, the radiant heat transfer effect may be improved and thus the uniform heating and the uniform cooling may be further achieved in the heat treatment process S3.

Although the embodiments of the present invention have been described in detail, a few design modifications may be made in these embodiments without departing from the principles and scope of the invention.

For example, although the above-mentioned embodiments describe that the heat uniformizing jig has the peripheral wall portion 12, the upper bottom surface 13, and the lower bottom surface 14 so as to cover the entire impeller 1, the heat uniformizing jig, for example, may also be configured by only the peripheral wall portion 12.

In addition, although the embodiments of the present invention illustrate the impeller 1 as a heat treatment object, the present invention may be similarly applied to heat treatments other than that of the impeller 1. Furthermore, the present invention may be similarly applied to heat treatments other than the quenching and tempering described in the above-mentioned embodiments. For example, the heat treatments may include a solution heat treatment, an aging heat treatment, etc.

In addition, the vacuum furnace 3 is not limited to the above-mentioned embodiments. For example, a case in which two or more stirring fans 5 are installed, a case in which no stirring fan 5 is installed, and a case in which the installation surfaces of the heaters 5 and the number of installation surfaces are different from each other may be similarly applied to the embodiments.

In addition, although the embodiments of the present invention describe, for example, the closed type impeller having the cover 1*b* as a heat treatment object, the present invention may be similarly applied to an open type impeller not having the cover 1*b*.

In addition, although the embodiments of the present invention describe a case of using the vacuum furnace 3 as a heating furnace, the present invention is not limited thereto. For example, any one of an atmosphere furnace having an inner pressure equal to atmospheric pressure and a press furnace having a pressure higher than atmospheric pressure may also be similarly applied to the embodiments. In this case, a reducing gas is preferably used as the atmosphere gas in order to maximally suppress the oxidation reaction during the heat treatment.

INDUSTRIAL APPLICABILITY

According to the above heat treatment method, extra thickness may be reduced while realizing heat uniformizing in a heat treatment process and preventing a heat treatment time from lengthening, by performing a treatment target material covering process using a covering body made of a radiation conversion material.

REFERENCE SIGNS LIST

1 Impeller (treatment target material)
1*a* Disc
1*b* Cover
1*c* Blade
1*d* Introduction port
2 Heat uniformizing jig (covering body)
2A, 2B Heat uniformizing jig
3 Vacuum furnace
3*a* Furnace sidewall
4 Heater
5 Stirring fan
10 Passage
11 Axial hole
12 Peripheral wall portion
12*b* Convex portion
13 Upper bottom surface
14 Lower bottom surface
S1 Heat treatment preparation process
S2 Impeller covering process (treatment target material covering process)
S3 Heat treatment process
S3*a* Heating process
S3*b* Cooling process
P Axis line
G Nitrogen gas (fluid)
S10 First insertion process
20 Passage insertion jig
S11 Second insertion process
21 Axial hole insertion jig

The invention claimed is:

1. A heat treatment method of a disc-shaped treatment target material, the heat treatment method comprising:

a treatment target material covering process of covering an outer peripheral surface of the treatment target material in a circumferential direction with a covering body made of a radiation conversion material which radiates transferred heat as radiant heat; and a heat treatment process of performing heat treatment by heating or cooling the treatment target material covered with the covering body from the periphery, wherein:

the treatment target material is an impeller having an axial hole into which a rotary shaft is capable of being inserted;

the heat treatment method further comprises a first insertion process of inserting an axial hole insertion body made of the radiation conversion material into the axial hole; and the heat treatment process is performed in a state in which the axial hole insertion body is inserted into the axial hole.

2. The heat treatment method according to claim 1, wherein:

in the treatment target material covering process, a member made of the radiation conversion material having permeability is used as the covering body; and in the heat treatment process, a fluid in a heat treatment atmosphere flows from the outside of the covering body to the treatment target material due to permeability of the covering body.

3. The heat treatment method according to claim 2, wherein, in the treatment target material covering process, the treatment target material is also covered from an axial direction by the covering body.

4. A heat treatment method of a disc-shaped treatment target material, the heat treatment method comprising:

a treatment target material covering process of covering an outer peripheral surface of the treatment target material in a circumferential direction with a covering body made of a radiation conversion material which radiates transferred heat as radiant heat; and a heat treatment process of performing heat treatment by heating or cooling the treatment target material covered with the covering body from the periphery, wherein:

the treatment target material is an impeller having a passage therein;

the heat treatment method further comprises a second insertion process of inserting a passage insertion body made of the radiation conversion material into the passage; and the heat treatment process is performed in a state in which the passage insertion body is inserted into the passage.

5. The heat treatment method according to claim 4, wherein:

in the treatment target material covering process, a member made of the radiation conversion material having permeability is used as the covering body; and in the heat treatment process, a fluid in a heat treatment atmosphere flows from the outside of the covering body to the treatment target material due to permeability of the covering body.

6. The heat treatment method according to claim 5, wherein, in the treatment target material covering process, the treatment target material is also covered from an axial direction by the covering body.

7. A heat treatment method of a disc-shaped treatment target material, the heat treatment method comprising:

a treatment target material covering process of covering an outer peripheral surface of the treatment target material in a circumferential direction with a covering body made of a radiation conversion material which radiates transferred heat as radiant heat; and a heat treatment process of performing heat treatment by heating or cooling the treatment target material covered with the covering body from the periphery, wherein:

the treatment target material is an impeller having an axial hole into which a rotary shaft is capable of being inserted;

the heat treatment method further comprises a first insertion process of inserting an axial hole insertion body made of the radiation conversion material into the axial hole; and the heat treatment process is performed in a state in which the axial hole insertion body is inserted into the axial hole, wherein:

the treatment target material is an impeller having a passage therein;

the heat treatment method further comprises a second insertion process of inserting a passage insertion body made of the radiation conversion material into the passage; and the heat treatment process is performed in a state in which the passage insertion body is inserted into the passage.

8. The heat treatment method according to claim 7, wherein:

in the treatment target material covering process, a member made of the radiation conversion material having permeability is used as the covering body; and in the heat treatment process, a fluid in a heat treatment atmosphere flows from the outside of the covering body to the treatment target material due to permeability of the covering body.

9. The heat treatment method according to claim 8, wherein, in the treatment target material covering process, the treatment target material is also covered from an axial direction by the covering body.

* * * * *